United States Patent [19]

Rivaud

[11] Patent Number: 4,590,775

[45] Date of Patent: May 27, 1986

[54] PRESSURE EARRING

[76] Inventor: Jose M. C. Rivaud, Puertaferrisa 22, tienda, Barcelona, Spain

[21] Appl. No.: 698,627

[22] Filed: Feb. 6, 1985

[30] Foreign Application Priority Data

Jun. 12, 1984 [ES] Spain ..... 279.967

[51] Int. Cl.[4] ..... A44C 7/00

[52] U.S. Cl. ..... 63/14 G; 63/14 E; 24/49 C; 24/67 CF; 24/533; 24/545; D11/73

[58] Field of Search ..... 63/14 R, 14 B, 14 D, 63/14 E, 14 G; 24/30.55, 49 C, 67 CF, 67.9, 532, 533, 545, 555, 556, 563; D11/73

[56] References Cited

U.S. PATENT DOCUMENTS

| | | | |
|---|---|---|---|
| D. 144,804 | 5/1946 | Schein | D11/73 |
| 389,918 | 9/1888 | Bennett | 24/563 |
| 783,964 | 2/1905 | Keplinger | 24/67 CF |
| 869,965 | 11/1907 | Farnham | 63/14 G |
| 1,106,388 | 8/1914 | Juergens | 63/14 G |
| 1,121,086 | 12/1914 | Gedney | 24/563 |
| 1,265,139 | 5/1918 | Tittle | 24/555 |
| 1,439,731 | 4/1924 | Baldwin | 24/532 |
| 1,622,682 | 3/1927 | Sponsel | 24/563 |
| 1,624,514 | 4/1927 | Smith | 24/563 X |

FOREIGN PATENT DOCUMENTS

| | | | |
|---|---|---|---|
| 247506 | 12/1947 | Switzerland | 24/545 |
| 259904 | 7/1949 | Switzerland | D11/48 |

*Primary Examiner*—F. Barry Shay
*Attorney, Agent, or Firm*—Michael J. Striker

[57] ABSTRACT

An earring which simulates an object piercing the wearer's ear lobe, having a low, wide, U-shaped rear part and spaced front parts. The base of the U-shaped part fits behind the lobe and its sides fit around the sides of the lobe and support the spaced front ornamental parts which represent the two ends of the simulated ear-piercing object. At the center of the base is a pressing part. The earring is made of a single piece of resilient material and may be flexed to fit around and grip the tip of the lobe.

6 Claims, 8 Drawing Figures

PRESSURE EARRING

BACKGROUND OF THE INVENTION

This patent relates to a pressure earring having the particularity of simulating that it outwardly pierces through the ear-lap (i.e. the ear lobe), which causes a great effect from the ornamental point of view. Thanks to the very studied combination of the parts making up the aforementioned earring, that simulation is perfect not being, however, in any way affected by such false piercing the user's ear skin.

SUMMARY OF THE INVENTION

It is an object of the invention to provide an improved pressure earring which would have a great ornamental effect.

Basically, the earring is made up by a part sensibly having the shape of a low height "U" of an appropriate material and variable dimensions. This part is fixed on both ends to the two respective aligned halves of an adorning element normally representing a perforating object, such as an arrow, a sword, a lance, or a similar item, the two halves of which are blunt on their facing edges and are separated from each other. The separation or open space is placed opposite to a pressing and retaining pushing part existing at the bottom of that "U"-shaped part which is aimed to be applied against the back side of the ear-lap once the latter has been entered into the earring, so that the ear-lap fore side be forced to protrude on that frontal open room in order to give the feeling that the trimming has outwardly pierced the ear-lap.

When made of plastic material, the earring is of a single filament shape and elastic nature, constituting the ear-lap back side pushing or pressing part by an angular deflection built-in on the bottom of the aforementioned "U"-shaped part.

When this earring is made of a rigid material, that pressing part consists, as preferred making, of a screw applied to a threaded neck provided at the bottom of the same "U"-shaped part, this screw having, in addition to the external operating head, a discoidal internal end to perform that retaining presure against the ear-lap internal side.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIGS. from 5 to 7 are views of the earring made of an elastic plastic material.

DETAILED DESCRIPTION OF THE PREFERRED EMBODIMENTS

Figure 1:
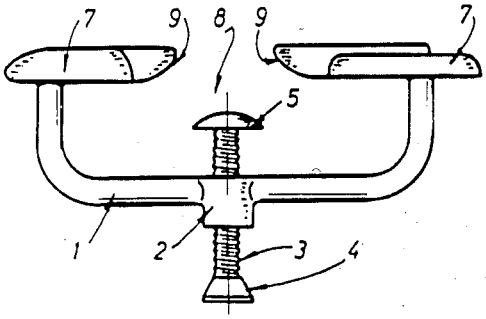
FIG. 1 is elevation side view of the earring made of a rigid material.
Figure 2:
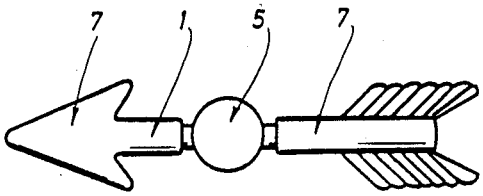
FIG. 2 is a plan view of the same.
Figure 3:
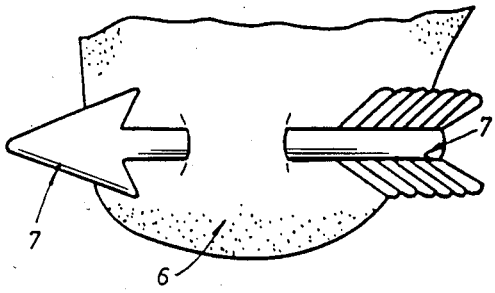
FIG. 3 shows the earring of FIG. 1, applied to the ear-lap.
Figure 4:
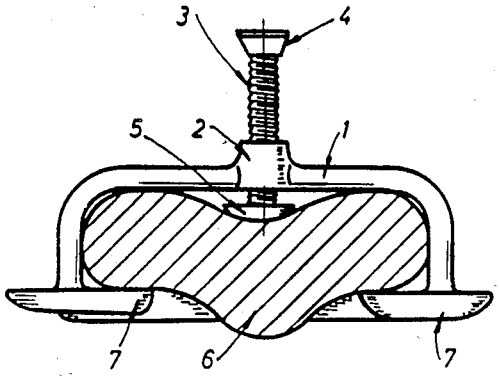
FIG. 4 is a cross sectional view of the ear-lap and showing the mode of action of the earring to obtain the aforementioned false piercing effect.
Figure 5:
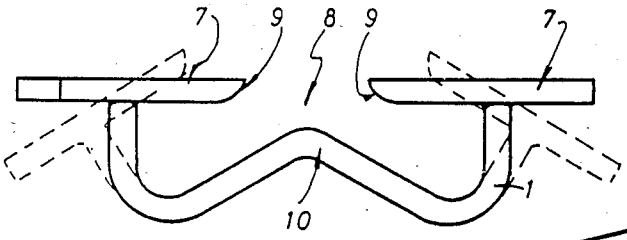
Figure 6:
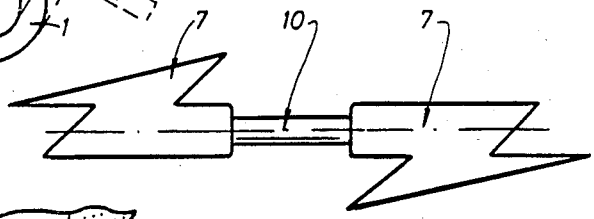
Figure 7:
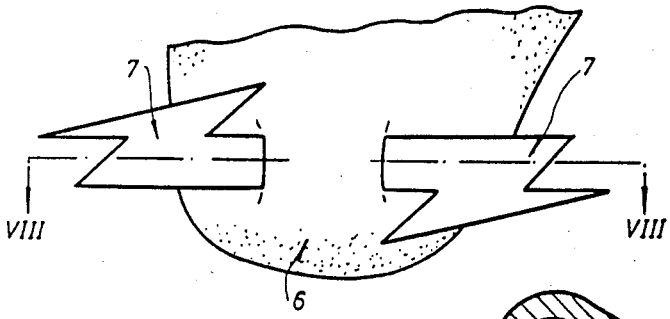

The earring of this invention is constituted by a rod, wire, or filament of any appropriate material, for instance metal in the embodiment of FIGS. from 1 to 4 this rod is bent to form an "U"-shaped part 1 of reduced height, which is provided in its central portion with a neck 2, internally threaded to house a screw 3 having a handling head 4 and a convex discoidal end 5 adapted to be applied under pressure against the internal or back side of the ear lap 6 (FIG. 4).

Figure 8:
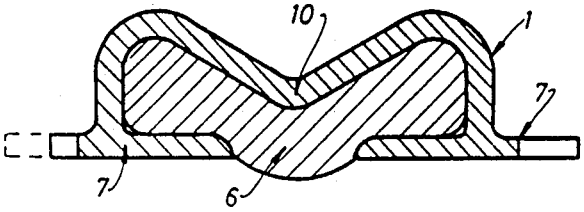
FIG. 8 is a cross section taken on the line VIII—VIII of FIG. 7.

The single filament or "U"-shaped part 1 is fixed at its ends to the decorative trimming, which forms the earring visible side. This ornamental trimming may have any form, normally that of a perforating instrument such as an arrow, a lance, a sword, or the like. The perforating instrument is always made up by two aligned halves 7, which are separated by a central open space 8. In the embodiment of FIGS. 1 to 4, the aforementioned ornamental part is defined by a cut arrow, but it could be determined by any other element such as the ray or spark as in the embodiment of FIGS. 5 to 8. In all cases, the impression sought is that of a perforation due to a sharp object that pierces the ear-lap 6 which is placed between the part 1 and the trimming 7, and is surrounded at its back side by that part 1 (FIG. 8).

In FIG. 4 it can be seen the ear-lap deformation under the action of the screw 3 which, when it is turn tight, forces the fore side of the ear-lap to protrude through the space or opening 8. The ear skin is not damaged since the opposite edges of those halves 7 are made blunt at 9.

In the embodiment of FIGS. 5 to 8, the earring consists of one piece only and made of an elastic plastic material and its single filament "U"-shaped portion 1 has, in its centre or bottom, a pushing deflection 10 instead of the screw -3- of the former embodiment, having the same function as the latter. Deflection 10 is angular and has an obtuse angle. As it can be seen in FIG. 5, the trimming halves 7 can be bent or opened, due to material elasticity, at the moment of putting the earring on, after which the closing occurs automatically and the pressure exerted by the deflection 10 gives place to ear-lap 6 advance and the protrusion of a part of it through the opening 8.

This earring, when it is made of a rigid material (FIGS. 1 to 4), requires the operation of screw 3 so as to put it on and to take the earring out, while in the embodiment of FIGS. 5 to 8, it is sufficient with a slight deformation 7 (FIG. 5) to allow the introduction and the extraction of the earring from the ear-lap 6, all which implies an improvement from the practical point of view.

In both cases the results obtained are the same and can be summarized as follows:

(a) It is a "U"-shaped element with its ends provided with the aligned two halves having an ornamental trimming, usually in the form of a perforating instrument;

(b) In one case, the protrusion of a part of the ear-lap on the visible side is obtained by means of a pressing screw, while in the other embodiment the pressing action is exerted by a simple pushing of an angular deflection portion that produces the same effect;

(c) As seen from the front the illusion that the ear-lap is pierced through by the ornamental trimming is complete in both cases.

Modifications can be introduced in the materials used, colours, dimensions, ornamental characteristics and other details of a secondary order not affecting the essence of the invention.

I claim:

1. Pressure earring, comprising a substantially U-shaped supporting member having two legs and a bottom, each of the legs carrying at a free end thereof an adorning trimming portion, each trimming portion being shaped as a half of a perforating object, said portions together forming a representation of a perforating object, the trimming portions projecting towards each other with mutually confronting ends spaced from each other to form an open space therebetween; said bottom, legs and trimming portions being constructed and arranged to pass around the back, sides and part of the front of the ear lap at a location spaced upwardly from the ear lap lower end so that the view of the front of the ear lap at said lower end is obstructed by the earring; and pressing means on said bottom of the supporting member, said pressing means being applicable to the back side of an ear lap once the latter has been introduced inside the U-shaped supporting member, the ear lap being adapted to be forced by said pressing means into said open space so that a front part of the ear lap protrudes through said open space whereby the trimming portions give a viewer a feeling that the trimming portions pierce the ear lap; said pressure earring being made of one piece only.

2. The earring as defined in claim 1, wherein said trimming portions have blunt edges.

3. The earring as defined in claim 1, wherein said perforating object is formed as an arrow.

4. The earring as defined in claim 1, wherein said perforating object is formed as a lance.

5. The earring as defined in claim 1, wherein said perforating object is formed as a spark.

6. The earring as defined in claim 1, and made of elastic material, said pressing means being formed by an angular deflected portion on said bottom, said deflected portion projecting towards said open space to apply pressure against the back side of the ear lap and to cause the protrusion of the front side of the ear lap through the open space between the trimming portions.

* * * * *